United States Patent [19]

Carriere

[11] Patent Number: 5,033,452

[45] Date of Patent: Jul. 23, 1991

[54] DEVICE FOR THAWING GROUND

[75] Inventor: Leo J. Carriere, Lloydminster, Canada

[73] Assignee: Richard Graham, Lloydminster, Canada

[21] Appl. No.: 600,678

[22] Filed: Oct. 22, 1990

[30] Foreign Application Priority Data

Nov. 21, 1989 [CA] Canada ..... 2003536

[51] Int. Cl.[5] ..... F23C 5/00

[52] U.S. Cl. ..... 126/271.1; 126/271.2 R

[58] Field of Search ..... 126/271.1, 271.2 R, 126/271.2 A, 271.2 C, 271.3, 389; 165/45; 405/131, 56, 57, 152, 234

[56] References Cited

U.S. PATENT DOCUMENTS 2,525,213 10/1950 Doolin ..... 126/389

*Primary Examiner*—James C. Yeung

*Attorney, Agent, or Firm*—Murray E. Thrift; Stanley G. Ade; Adrian D. Battison

[57] ABSTRACT

A ground thawing apparatus has a housing containing a fire tube for generating high heat conditions within the housing. The housing is thermally insulated to prevent excessive heat loss. In one embodiment, the roof of the housing is peaked and carries a steam vent along the underside of its ridges. The steam vent is a V-shaped baffle with inlet slots along the side edges, where it meets the roof, and outlet or drain openings in opposite ends of the housing, at the base of the V. In another embodiment, a steam vent is a tube leading from the interior of the housing to the interior of the flue for the fire tube. The steam vent allows the escape of excessive amounts of moisture vapor from the housing without undue heat loss.

12 Claims, 3 Drawing Sheets

DEVICE FOR THAWING GROUND

FIELD OF THE INVENTION

The present invention relates to the thawing of frozen ground and more particularly to a ground thawing apparatus.

BACKGROUND

In cold climates it is often necessary to dig into frozen ground, for example to service underground utilities. Frozen ground is extremely difficult to dig, because the moisture content of the soil acts as a cement producing a solid mass somewhat akin to concrete with the soil acting as an aggregate. Devices have therefore been proposed for thawing frozen ground to allow the desired ground digging. The prior art devices for this purpose have included open bottomed housings containing heaters that generate a hot zone above the ground, under the housing. With such a device, the accumulation of steam within the housing acts to inhibit the evaporation of liquid water on the ground, which acts as a heat absorbing, insulating layer in the top layer of the ground, so that heat penetration into the soil is very slow.

Other disadvantages of the known devices include the use of refractory lined combustion chambers that increase weight and reduce the available area for heating and ineffecient systems for using hot gases for thawing.

The present invention is concerned with an improved ground thawing device of this type.

SUMMARY

According to the present invention there is provided a ground thawing apparatus comprising:

a housing having a thermally insulated roof, thermally insulated side walls and an open bottom;

a fire tube with first and second ends and extending through the housing;

burner means for generating hot combustion gases and introducing the gases directly into the first end of the fire tube;

flue means connected to the fire tube adjacent the second end, for exhausting combustion gases from the fire tube;

steam vent means communicating the chamber with the exterior of the housing; and restrictor means restricting steam flow through the vent means.

The steam vent allows the release of excess moisture as vapor or condensate from the housing, with the restrictor retaining most of the steam and therefore heat inside the housing. This allows continued evaporation of moisture from the soil, preventing its accumulation as an insulating layer in the soil. Such moisture does not readily evaporate under a housing without the steam vent because of the saturation conditions within the housing.

In one embodiment of the invention, the housing has a peaked roof and the steam vent includes a V-shaped, insulated baffle under the peak. The restrictor means for restricting the flow to the steam vent are slots where the walls of the baffle meet the roof, while a drain or outlet opening is provided at the root of the baffle so as to drain condensed vapor.

In another, preferred embodiment of the invention the steam vent is an opening into the flue from the housing interior. The restrictor is a pipe leading from the interior of the housing into the flue. The low static pressure in the flue draws steam from the housing into the exiting exhaust gases. This leads the moisture to the top of the flue, usually an overhead elevation, to avoid the generation of a ground level cloud of condensed vapour. This embodiment is also especially useful when thawing ground surfaced with asphalt or the like since noxious fumes given off by the heated asphalt are led out through the flue. Where the combustion gases are sufficiently hot, asphaltic fumes may be consumed before they are exhausted.

The continuous removal of water from the housing allows the continuous, rapid vaporization of liquid from the ground and rapid thawing to significant depths.

BRIEF DESCRIPTION OF THE DRAWINGS

In the accompanying drawings, which illustrate exemplary embodiments of the present invention.

DETAILED DESCRIPTION

Figure 1:
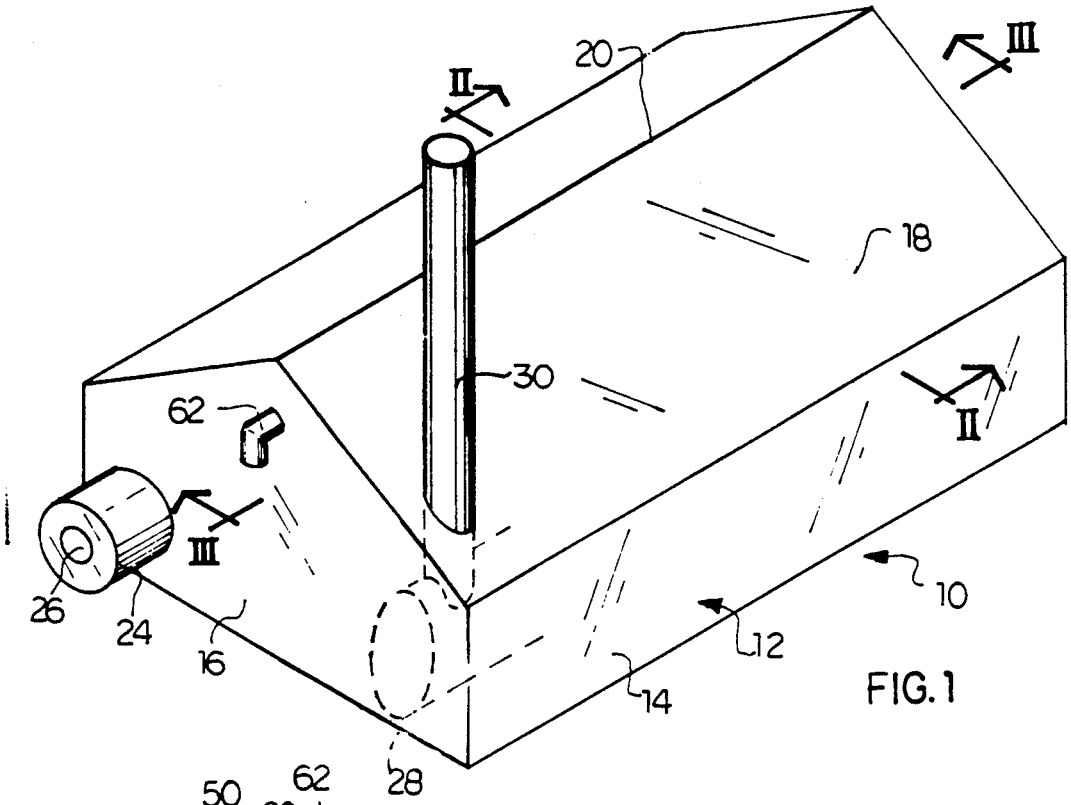
FIG. 1 is an isometric view of an apparatus according to the present invention.
Figure 2:
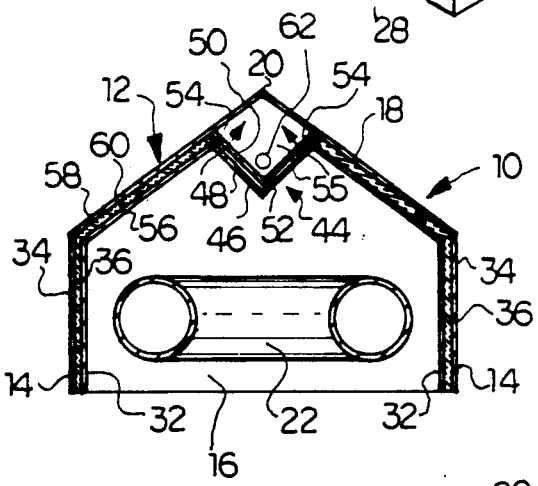
FIG. 2 is a sectional elevation along line II—II of FIG. 1.
Figure 3:
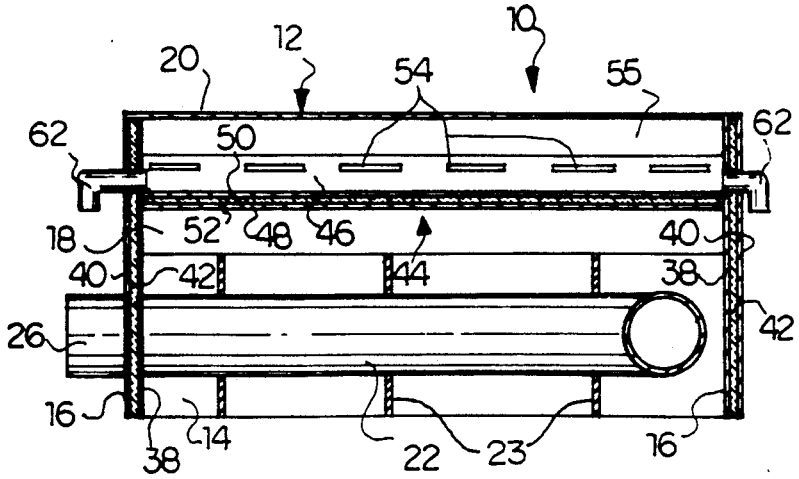
FIG. 3 is a sectional elevation along line III—III of FIG. 1.

Referring to the accompanying drawings, and especially to FIGS. 1, 2 and 3, there is illustrated a ground thawing apparatus 10. The apparatus includes a rectangular housing 12 with parallel side walls 14 and end walls 16. The housing has a peaked roof 18 with a ridge 20 parallel to the side walls 14.

A U-shaped fire tube 22 extends the length of the housing. One end 24 of the fire tube carries a propane burner head 26 connected to a tank of propane gas (not shown). The other end 28 of the fire tube is blanked off and carries an exhaust stack 30 for exhausting combustion products.

As illustrated most particularly in FIG. 2, each of the side walls 14 is composed of an inner panel 32 and an outer panel 34, spaced apart and parallel. Between the two panels is a layer of thermal insulation 36. Similarly, the end walls 16 have inner panels 38, outer panels 40 and insulation 42 between the inner and outer panels.

Along the roof 18, immediately below the ridge 20, is a steam vent 44. This is a V-shaped baffle 46 constructed, like the side walls of the housing, with an inner panel 48, an outer panel 50 and thermal insulation 52 sandwiched between. Along the side edges of the baffle walls, adjacent the roof are inlet slots 54. These act as restrictors allowing a limited flow of moisture vapor into the chamber 55 inside the steam vent 44. Between the baffle 46 and the side walls, the roof 18 is, like the other components of the housing, made of a sandwich construction including inner panels 56, outer panels 58 and thermal insulation 60 between the panels. Directly above the chamber 55, the roof is uninsulated.

At each end of the steam chamber 55 is an outlet or drain 62 that is located at the base of the V-shaped baffle. The drain allows liquid water in the chamber 55 to run out of the chamber and also provides an egress for vapor.

With the apparatus illustrated in FIGS. 1, 2 and 3, a fire at the burner 26 produces a high heat that is transmitted along the fire tube 22 and transmitted into the housing 12 to generate very high heat conditions therein. The high heat within the housing acts to melt the surface layer of the frozen ground on which it is resting and subsequently to vaporize moisture from the thawed ground. If the housing was completely enclosed, this would ultimately produce saturation conditions within the housing, so that liquid would accumulate on the ground within the housing, forming an insulating layer over the frozen ground. In the present apparatus, however, the vapor is allowed to escape through the steam vent 44 by way of the slots 54. From the chamber 55, the moisture is drawn off through the drain 62. This produces a controlled release of the moisture from the housing, so that excessive heat is not lost, while preventing the saturation conditions that inhibit further vaporization of ground moisture.

Figure 4:
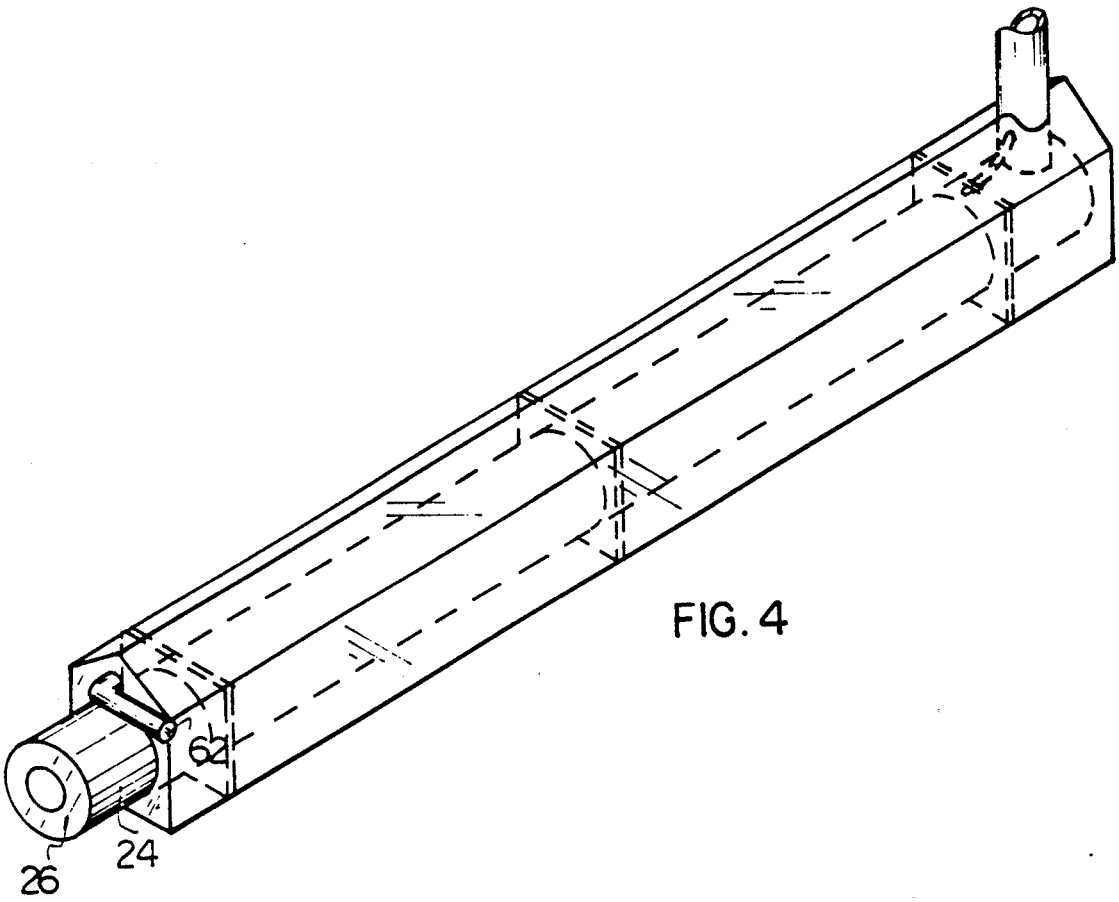
FIG. 4 is an isometric view of another embodiment of the present invention.
Figure 5:
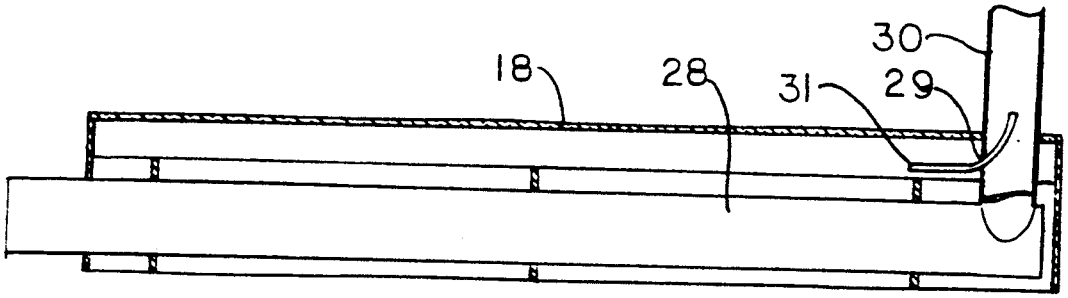
FIG. 5 is a view along line 5—5 of FIG. 4.

FIG. 4 of the drawings illustrates an alternative embodiment of the thawing apparatus that is particularly suited for thawing ground in which a slit trench is to be formed. The housing is a narrow, elongate housing containing a linear fire tube. The embodiment of FIGS. 4 and 5 also includes an alternative form of steam vent. As illustrated in the drawings, the fire tube extends through the housing but does not exit through the end wall. As illustrated in FIG. 5, the flue 30 is connected to the fire tube 28 near its closed end and exits from the housing through the roof 18. Within the housing, a steam vent opening 29 is formed in the side of the flue and a restrictor pipe 31 passes through that opening, from the interior of the housing at a location spaced from the flue, into the flue. The relatively low pressure of the exhaust gases passing through the flue will draw the relatively high pressure steam from the interior of the housing, through the pipe 31. Appropriate orientation of the end of the pipe within the flue walls will produce an aspiration effect tending to draw additional steam from the housing. This embodiment of the steam vent exhausts moisture from the housing to a position well above the ground and in a flow of hot gases that carry the moisture up and away from the apparatus. This minimizes the formation of a cloud of condensed moisture in the vicinity of the thawing apparatus.

The steam vent in FIGS. 4 and 5 is also particularly useful when the apparatus is used on a surface such as asphalt where the heated surface will give off noxious fumes. The fumes will be drawn through the steam vent into the hot combustion gases in the flue. If the combustion gases are sufficiently hot, and if they contain excess air, there will be a combustion of the asphaltic fumes in the flue, resulting in a clean exhaust from the apparatus.

The fuel used by the burner 26 is preferably propane, which is easily handled in tanks 27 and eliminates any requirement for an auxiliary power supply. Propane is exceptionally clean burning and there is therefore no risk of atmospheric pollution.

Figure 6:
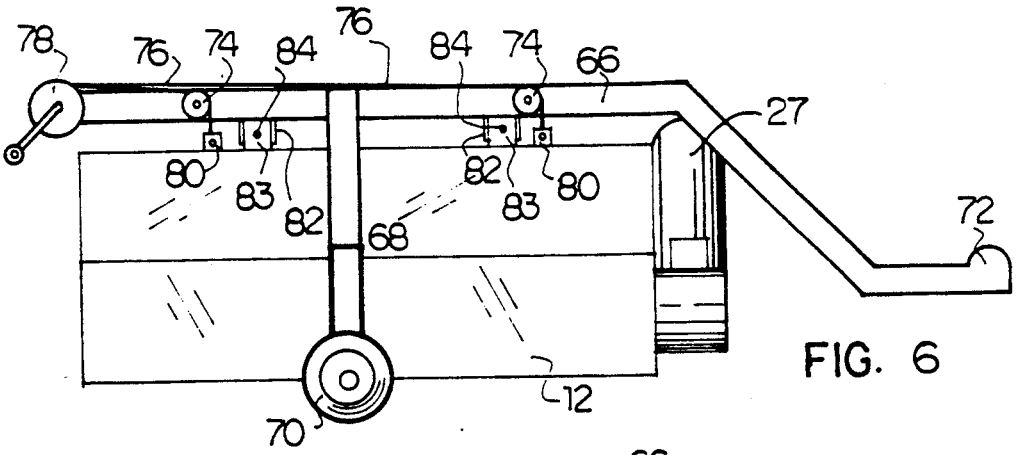
FIGS. 6 and 7 are side and end elevations respective of a trailer for carrying the thawing apparatus.
Figure 7:
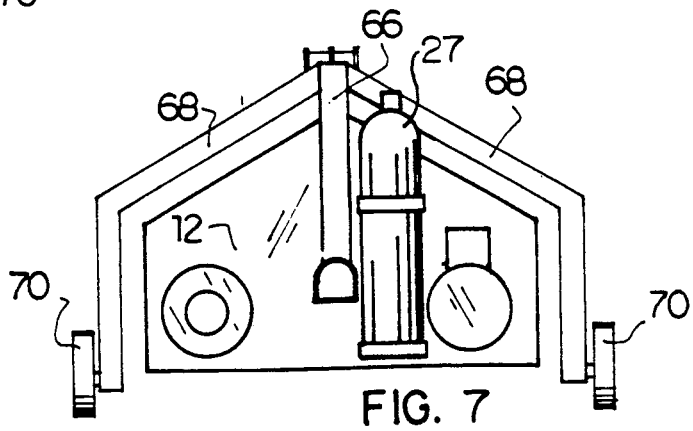

The thawing apparatus illustrated in FIGS. 1, 2 and 3 may readily be transported using a trailer such as that illustrated in FIGS. 6 and 7. The trailer 64 includes a centre beam 66 with two legs 68 projecting from its opposite sides to straddle the housing 12 of the apparatus. Each of the legs carries a wheel 70. At the front end, the beam 66 carries a trailer hitch 72.

Part way along the beam 56 are two sheaves 74. Each of these entrains a cable 76 that is wound at one end onto the drum of a winch 78. The opposite end of each cable 76 is connected to a lug 80 fitted to the top of the housing 12. Reeling in the cable 76 with the winch 78 thus raises the housing 12 towards the beam 66 so the housing will be suspended above the ground. The housing is locked in the raised position with a pin 84 extending through lugs 82 and 83 on the beam and the housing 12 respectively.

While particular embodiments of the present invention have been described in the foregoing, it is to be understood that other embodiments are possible within the scope of the invention. The invention is to be considered limited solely by the scope of the appended claims.

I claim:

1. A ground thawing apparatus comprising:

a housing having a thermally insulated roof, thermally insulated side walls and an open bottom;

a single, undivided fire tube mounted in the housing and extending therethrough, said fire tube having first and second ends;

burner means mounted to the first end of the fire tube for generating hot combustion gases in the first end of the fire tube;

flue means connected to the fire tube adjacent the second end of the fire tube for exhausting combustion gases from the fire tube;

steam vent means comprising passage means extending between the interior and the exterior of the housing and including restrictor means restricting steam flow through the passage means.

2. A thawing apparatus according to claim 1 wherein the roof is peaked, with an elongate ridge.

3. An apparatus according to claim 2 wherein the steam vent is located below the ridge.

4. An apparatus according to claim 1, wherein the housing roof and walls comprise respective inner and outer panels with thermal insulation therebetween.

5. An apparatus according to claim 1, wherein the housing is rectangular and the fire tube is a substantially U-shaped fire tube with the first and second ends adjacent a first end of the housing and a reverse bend in the tube adjacent an opposite second end of the housing.

6. An apparatus according to claim 1, wherein the housing is elongate and the fire tube is a substantially linear fire tube extending from one end of the housing to the other.

7. An apparatus according to claim 1 wherein the vent means comprises means entirely within the housing for venting the interior of the housing to the flue means.

8. An apparatus according to claim 1 wherein the vent means comprises a tube passing directly from within the housing into the flue means.

9. A ground thawing apparatus comprising:

a housing having a thermally insulated peaked roof with an elongate ridge, thermally insulated side walls and an open bottom;

a fire tube mounted in and extending through the housing, the fire tube having first and second ends;

burner means mounted to the first end of the fire tube for generating hot combustion gases in the first end of the fire tube;

flue means connected to the fire tube adjacent the second end of the fire tube, for exhausting combustion gases from the fire tube;

steam vent means comprising a V-shaped baffle with upwardly diverging walls, located below the ridge and defining a chamber between the baffle and the roof, first passage means extending from the housing to the chamber, and second passage means extending from the chamber to the exterior of the housing; and restrictor means restricting steam flow through the vent means.

10. An apparatus according to claim 9 wherein the restrictor means comprise slots between the upper ends of the baffle walls and the roof.

11. An apparatus according to claim 10 wherein the vent means comprises a drain through a wall of the housing adjacent the bottom of the baffle.

12. An apparatus according to claim 9 including thermal insulation means insulating the housing walls, the vent walls and the housing roof between the vent and the housing walls.

* * * * *